US008447574B2

(12) United States Patent
Wang et al.

(10) Patent No.: US 8,447,574 B2
(45) Date of Patent: May 21, 2013

(54) METHOD FOR SIMULATING TRANSIENT HEAT TRANSFER AND TEMPERATURE DISTRIBUTION OF ALUMINUM CASTINGS DURING WATER QUENCHING

(75) Inventors: Qigui Wang, Rochester Hills, MI (US); Cherng-Chi Chang, Troy, MI (US); Jayaraman Sivakumar, Grand Blanc, MI (US); Michael R. Harper, Canton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 434 days.

(21) Appl. No.: 12/856,257

(22) Filed: Aug. 13, 2010

(65) Prior Publication Data

US 2012/0041726 A1 Feb. 16, 2012

(51) Int. Cl.
*G06F 17/10* (2006.01)

(52) U.S. Cl.
USPC ..... 703/2

(58) Field of Classification Search
USPC ..... 703/2
See application file for complete search history.

(56) References Cited

PUBLICATIONS

Siefken et al.; SCDAP/RELAP5 Modeling of Heat Transfer and Flow Losses in Lower Head Porous Debris; Report prepared for the U.S. Nuclear Regulatory Commission; 1999; 78 pp.*

Hall et al.; Optimization of quench history of aluminum parts for superior mechanical properties; International Journal of Heat and Mass Transfer, vol. 39, No. 1, Jan. 1996 , pp. 81-95.*

Narumanchi et al.; Numerical Simulations of Boiling Jet Impingement Cooling in Power Electronics; Conference Paper; NREL/CP-540-39401; Dec. 2006; 24 pp.*

Li, P., et al., Simulating the Residual Stress in an A356 Automotive Wheel and Its Impact on Fatigue Life, 2007, Metallurgical and Materials Transactions B, 38(4) pp. 505-515.

(Continued)

*Primary Examiner* — Hugh Jones
(74) *Attorney, Agent, or Firm* — Dinsmore & Shohl LLP

(57) ABSTRACT

The invention relates to a method for estimating heat transfer during water quench of an aluminum part. The method includes:

estimating the heat transfer of the aluminum part when a temperature of the part is greater than 500° C. using $$q=\alpha(\Delta T) \quad (1);$$

estimating the heat transfer of the aluminum part when the temperature of the part is greater than $T_2$ and less than 500° C. using $$q=k_1\Delta T^{k2} \quad (4);$$

estimating the heat transfer of the aluminum part when the temperature of the part is greater than $T_1$ and less than $T_2$ using a critical point function equation selected from:

$$q = q_{max} - q_0\left(\frac{T_{metal} - T_{max}}{T_2 - T_1}\right)^2, \quad (3)$$

$$q^n = a_0 + a_1\Delta T + a_2\Delta T^2 + a_3\Delta T^3 + \ldots + a_n\Delta T^n, \quad (6)$$

$$q = q_{max} - \left(1 - 4\left((1-\varphi)\left(\frac{T_{metal} - T_{max}}{T_2 - T_1}\right)^2\right)\right), \quad (7)$$

$$q = q_{max} - \left(1 - \left(\frac{T_{metal} - T_{max}}{T_2 - T_1}\right)^2\right), \quad (8)$$

or $$q(T_1) = q(T_2) = \varphi q_{max}; \quad (9)$$

estimating the heat transfer of the aluminum part when the temperature of the part is less than $T_1$ using $$q=c_1\Delta T^{c2} \quad (5).$$

Systems, methods, and articles to predict transient heat transfer, or temperature distribution, or both of a quenched aluminum casting are also described.

11 Claims, 9 Drawing Sheets

PUBLICATIONS

Li, K., et al., Residual Stresses in As-Quenched Aluminum Castings, SAE International Journal of Materials & Manufacturing, 1(1) pp. 725-731, 2008.

Holman, J.P., Heat Transfer, McGraw-Hill, New York, Chapter 9, pp. 486-487.

Nukiyama, S., The Maximum and Minimum Values of the Heat Q Transmitted From Metal to Boiling Water Under Atmospheric Pressure, International Journal of Heat and Mass Transfer, 27(7), pp. 959-970, 1984.

Rohsenow, W., A Method of Correlating Heat Transfer Data for Surface Boiling of Liquids, Trans. ASME vol. 74, pp. 969-976, 1952.

* cited by examiner

METHOD FOR SIMULATING TRANSIENT HEAT TRANSFER AND TEMPERATURE DISTRIBUTION OF ALUMINUM CASTINGS DURING WATER QUENCHING

FIELD OF THE INVENTION

The present invention relates generally to methods for accurately calculating the transient heat transfer and temperature distribution of aluminum alloys and more particularly for calculating the transient heat transfer and temperature distribution of cast aluminum alloys during water quench.

BACKGROUND TO THE INVENTION

Aluminum alloy castings are widely used in the automotive industry to reduce weight and improve fuel efficiency. To improve mechanical properties, the aluminum castings are usually subject to a full T6/T7 heat treatment, which includes a solution treatment at a relatively high temperature, quenching in a cold medium such as water, and then age hardening at an intermediate temperature. A significant amount of residual stresses can be developed in aluminum castings when they are quenched, particularly in water. Li, P., Maijer, D. M., Lindley, T. C., 2007, "Simulating the Residual Stress in An A356 Automotive Wheel and its Impact on Fatigue Life," Metallurgical and Materials Transactions B, 38(4) pp. 505-515; Li, K., Xiao, B., and Wang, Q., 2009, "Residual Stresses in As-Quenched Aluminum Castings," SAE International Journal of Materials & Manufacturing, 1(1) pp. 725-731. The existence of residual stresses, in particular tensile residual stresses, can have a significant detrimental influence on the performance of a structural component. In many cases, the high tensile residual stresses can also result in a severe distortion of the component, and they can even cause cracking during quenching or subsequent manufacturing processes. Li, P., Maijer, D. M., Lindley, T. C., 2007, "Simulating the Residual Stress in An A356 Automotive Wheel and Its Impact on Fatigue Life," Metallurgical and Materials Transactions B, 38(4) pp. 505-515; Lee, Y. L., Pan, J., Hathaway, R., 2005, "Fatigue Testing and Analysis: Theory and Practice," Elsevier Butterworth-Heinemann, pp. 402.

The amount of residual stresses and distortion produced in cast aluminum components during quenching depends significantly on the quenching rate and the extent of non-uniformity of the temperature distribution in the casting during quenching. The heat transfer of aluminum castings during quenching involves conduction, convection, radiation, and even phase transformation, depending upon quenching medium. In a water quenching process, the heat transfer of the aluminum castings involves at least three main stages including film boiling (1), nucleate boiling (2), and convection (3), as illustrated in FIG. 1. Holman, J. P., 2002, "Heat Transfer," McGraw-Hill, N.Y., pp. 665.

Each of these stages has very different characteristics. The first stage of cooling is characterized by the formation of a vapor film (steam) around the component. This is a period of relatively slow cooling during which heat transfer occurs by radiation and conduction through the vapor (steam) blanket. With the increase in the thickness of the vapor (steam) film, however, the stable steam film eventually collapses, and water comes into contact with the hot metal surface, resulting in nucleate boiling and a high heat extraction rate. With the continuous boiling, the metal surface temperature decreases rapidly to a point at which boiling ceases and heat is removed by convection into the water. As a result, heat is removed very slowing during this stage.

FIG. 2 illustrates a general relationship between the heat transfer rate a and the temperature difference ΔT (the quench process proceeds in the direction of the arrow (from right to left). When the hot metal surface contacts the water at the beginning of quenching, the ΔT is so high that the generation of steam becomes too fast, and most of the metal surface is covered by the steam bubbles (film boiling (1)). As a result, there is no more water in direct contact with the metal surface to be agitated. Therefore, a negative effect takes place (because of the low α of steam, the heat-transfer rate is 1/20 that of water), and it becomes a matter of heat transfer between the metal surface and the steam mainly through conduction. A relatively slow cooling continues with the increase of the thickness of the steam blanket and the decrease of ΔT, as illustrated in FIG. 2. When α and q decrease to a point at a in the α–ΔT curve (FIG. 2), the stable steam film eventually collapses, and water comes into contact directly with the hot casting surface resulting in nucleate boiling (2) and a quick increase of the heat extraction rate (between a to b in α-ΔT curve in FIG. 2). At this stage, the water is fully agitated by the generated steam bubbles. The maximum heat transfer $q_{max}$ is reached at point b in the α–ΔT curve by the combined effect of the increased a and the decreased ΔT. After point b, the boiling continues but becomes mild, and the metal surface temperature decreases rapidly. As a result, the agitation and the heat transfer rate a decrease dramatically following b-c in the α–ΔT curve in FIG. 2. When the casting surface temperature decreases to certain point, the boiling ceases, and heat is removed by convection (3) into the water. In this case, the heat transfer rate α is lower.

Because the boiling phenomenon is so complicated, theoretical analysis of the boiling heat transfer has long been a challenging problem, even with the state-of-the-art sophisticated computational fluid dynamics (CFD) algorithm. Although a relational function of α or q on ΔT is as presented in FIG. 2, where a and b are the points for the minimum and maximum values of q, the abc part of the curve (as will be discussed later) is so unstable that it is hard to obtain in practice.

Film Boiling

Film boiling can be treated as single phase wall problem. Nukiyama, S., 1984, "The Maximum and Minimum Values of the Heat Q Transmitted from Metal to Boiling Water Under Atmospheric Pressure," International Journal of Heat and Mass Transfer, 27(7) pp. 959-970. The heat transfer during film boiling is simply described as:

$$q=\alpha(\Delta T)(T_{metal}>\text{about } 500^\circ \text{ C.}) \quad (1)$$

where q is the heat transmitted from the casting surface per unit area per unit time to the water; α is the heat-transfer coefficient, and ΔT is the temperature difference between the casting surface and the water, as illustrated in FIG. 3. For cast aluminum components solution-treated at 540° C. and then quenched in water (<100° C.), the film boiling takes place at relatively high temperature (>500° C.).

Nucleate Boiling

The heat transfer during nucleate boiling can be calculated based on an empirical equation:

$$q=c_1(\Delta T)^{c_2}(T_{metal}<\text{about } 500^\circ \text{ C.}) \quad (2)$$

where $c_1$ and $c_2$ are constants that can be calibrated with the material and quench conditions, as illustrated in FIG. 3. Rohsenow, W. 1952, "A method of correlating heat transfer data for surface boiling of liquids", Trans. ASME vol. 74, 969-976.

Because of the complexity of phase transformation, and in particular bubble nucleation and interaction, accurate modeling of heat transfer of cast aluminum alloys in water quenching remains a significant challenge.

There are many classical empirical equations reported in the literature for calculating heat transfer and interface heat transfer coefficients. However, their applications are very limited because almost all of them are calibrated under certain specific experimental conditions which can be significantly different from the actual production situation. In recent years, CFD simulations of fluid flow and heat transfer have made significant progress. But, the current CFD prediction of heat transfer and temperature distribution of aluminum castings during water quenching is not accurate because the complicated interaction and heat transfer phenomena between water and hot aluminum castings are not fully understood and represented in the state-of-the-art fluid flow and heat transfer code. FIGS. 4A-B show examples of the significant discrepancy observed in the thermal simulation using a state-of-the-art fluid flow and heat transfer code in comparison with experimental measurements.

To precisely predict the amount of residual stresses and distortion induced in cast aluminum components during quenching as well as the mechanical properties and durability of the quenched cast aluminum components during service, it is vital to understand the heat transfer and calculate accurate temperature distributions in the casting during quenching. Therefore, there is a need to develop improved methods and systems that can accurately predict the heat transfer and temperature distributions in the cast aluminum components during water quenching.

SUMMARY OF THE INVENTION

The invention provides improved computational fluid dynamics methods and technologies to accurately simulate heat transfer from hot cast aluminum components to water during quenching. The invention is applicable to all age-hardenable aluminum alloys including both wrought and cast aluminum alloys.

For cast aluminum alloys, it was discovered that the heat transfer from nucleate boiling and in particular transition boiling is dominant. The heat transfer by film boiling is, however, very limited, as shown in FIG. 5A. There is a significant amount of variation in heat flux and cooling rate from location to location in the casting during quenching which is attributed to bubble formation, movement and interaction.

The heat flux transferred from the hot cast aluminum components to water during the transition stage can be described by two functions as illustrated in FIG. 6: one called the "critical point function" that defines the maximum heat flux point $q_{max}$ (Eqn. 3), and the other called the transition boiling function (Eqn. 4).

One aspect of the invention relates to a method for estimating heat transfer during water quench of an aluminum part. The method includes:

estimating the heat transfer of the aluminum part when a temperature of the part is greater than 500° C. using $$q=\alpha(\Delta T) \quad (1);$$

estimating the heat transfer of the aluminum part when the temperature of the part is greater than $T_2$ and less than 500° C. using $$q=k_1\Delta T^{k2} \quad (4);$$

estimating the heat transfer of the aluminum part when the temperature of the part is greater than $T_1$ and less than $T_2$ using a critical point function equation selected from:

$$q = q_{max} - q_0\left(\frac{T_{metal} - T_{max}}{T_2 - T_1}\right)^2, \quad (3)$$

$$q^n = a_0 + a_1\Delta T + a_2\Delta T^2 + a_3\Delta T^3 + \ldots + a_n\Delta T^n, \quad (6)$$

$$q = q_{max} - \left(1 - 4\left((1-\varphi)\left(\frac{T_{metal} - T_{max}}{T_2 - T_1}\right)^2\right)\right), \quad (7)$$

$$q = q_{max} - \left(1 - \left(\frac{T_{metal} - T_{max}}{T_2 - T_1}\right)^2\right), \quad (8)$$

or $$q(T_1) = q(T_2) = \varphi q_{max}; \quad (9)$$

estimating the heat transfer of the aluminum part when the temperature of the part is less than $T_1$ using $$q=c_1\Delta T^{c2} \quad (5);$$

where:

$\Delta T$ is the temperature difference (° K) between the hot cast aluminum component and the water used to quench the part;

$T_{metal}$ is the surface temperature of the part during quench;

$T_2$ is the temperature at an intersection point of the two curves described by the critical point function and equation (4);

$T_1$ is the temperature at the intersection point of the two curves described by the critical point function and equation (5);

$$T_{max} = \frac{T_1 + T_2}{2};$$

and $c_1$, $c_2$, $q_{max}$, $q_0$, $k_1$, $k_2$, and $a_0$, $a_1$, $a_2$, $a_3$, . . . , and $a_n$, are constants that depend upon quench conditions.

For cast aluminum alloys:

$c_1$ varies from about 2000 to about 13,000 W/($m^2K^{c2}$), or about 3500 to about 11,000 W/($m^2K^{c2}$);

$c_2$ varies from about 1.3 to about 1.9, or about 1.4 to about 1.6;

q from 1.5E+06 to 3E+06 W/$m^2$, or 1.5E+06 to 2.25E+06 W/$m^2$;

$k_1$ varies from 5E+09 to 9E+09 W/($m^2K^{k2}$), or 6E+09 to 7E+09 W/($m^2K^{k2}$); and $k_2$ varies from about −1.5 to about −2.0, or about −1.6 to about −1.7.

The above correlation can be implemented in a computational fluid dynamics (CFD) code. The implementation includes superposition of convective (single phase) and boiling heat flux at a solid-fluid interface.

Another aspect of the invention relates to a system to predict transient heat transfer, or temperature distribution, or both of a quenched aluminum casting. The system includes an information input configured to receive information relating to at least one of a plurality of at least one of nodes, and elements of the aluminum casting during a quenching thereof; an information output configured to convey information relating to transient heat transfer, or temperature distribution, or both of the aluminum casting predicted by the system; a processing unit; and a computer-readable medium comprising a computer-readable program code embodied therein, said computer-readable medium cooperative with the processing unit, the information input and the information output such that the received information is operated upon by the processing unit and computer-readable program code to be presented to the information output as transient heat transfer, or temperature distribution, or both of the aluminum casting, said computer-readable program code comprising a fluid flow simulation module, a turbulence boiling flow module, and a heat transfer module, wherein: the fluid flow simulation module simulates a quenching process of a virtual aluminum casting replicative of the aluminum casting and the quenching thereof, the virtual aluminum casting comprising a plurality of at least one of virtual surface nodes, and elements correlated with the surface geometries of the aluminum casting, the virtual aluminum casting respectively comprising a plurality of at least one of dimensional nodes, and elements; the turbulence boiling flow module simulates one or more of a velocity profile for a liquid phase, a pressure profile, and vapor/water phase interactions; the heat transfer module calculates a plurality of heat transfer coefficients specific to the respective virtual surface nodes, and elements; the heat transfer module estimates the heat transfer of the aluminum part using the equations described above; and the heat transfer module calculates a plurality of at least one of virtual node-specific, and element-specific temperatures using the heat transfer coefficients, the virtual node-specific, and element-specific-temperatures respectively specific to a time of the simulated quenching.

Another aspect of the invention is involves a method of predicting transient heat transfer, or temperature distribution, or both of an aluminum casting. One embodiment of the method includes: providing the aluminum casting, the aluminum casting comprising at least one of a plurality of at least one of nodes, and elements and has been quenched via a quenching process; simulating a quenching process of a virtual aluminum casting replicative of the aluminum casting and the quenching thereof, wherein the virtual aluminum casting comprises at least one of a plurality of virtual surface zones correlated with the nodes, and elements of the aluminum casting and the virtual surface zones respectively comprise a plurality of dimensional elements and the dimensional elements respectively comprise a plurality of nodes; calculating the turbulence boiling flow of the respective virtual nodes, and elements; estimating the heat transfer of the aluminum part using the equations described above; calculating a plurality of heat transfer coefficients specific to the respective virtual surface nodes, and elements; calculating a plurality of at least one of virtual node-specific, and element-specific temperatures using the respective surface node-specific, and element-specific heat transfer coefficients, the virtual node-specific, and element-specific temperatures respectively specific to a time of the simulated quenching; predicting heat transfer, or temperature distribution, or both of the respective virtual nodes, and elements using the virtual node-specific, and element-specific temperatures and a coefficient of thermal expansion/contraction.

Another aspect of the invention relates to an article of manufacture to predict transient heat transfer, or temperature distribution, or both of an aluminum casting. One embodiment of the article of manufacture includes an information input, an information output, and at least one computer usable medium, wherein: the information input is configured to receive information relating to at least one of a plurality of at least one of nodes, and elements of the aluminum casting during a quenching thereof; the information output is configured to convey information relating to the transient heat transfer, or temperature distribution, or both of the aluminum casting predicted by the article of manufacture; the computer useable medium comprises computer-readable program code means embodied therein for simulating a quenching of a virtual aluminum casting replicative of the aluminum casting and the quenching thereof, the virtual aluminum casting comprising at least one of a plurality of virtual surface nodes, and elements correlated with at least one of the nodes, and elements of the aluminum casting and the virtual surface zones respectively comprising a plurality of dimensional elements and virtual dimensional elements respectively comprising a plurality of nodes; the computer useable medium comprises computer-readable program code means embodied thereon for calculating turbulence boiling flow; the computer useable medium comprises computer-readable program code means embodied therein for: estimating the heat transfer of the aluminum part using the equations described above; the computer useable medium comprises computer-readable program code means embodied therein for calculating a plurality of heat transfer coefficients specific to the respective virtual surface nodes, and elements; the computer useable medium comprises computer-readable program code means embodied therein for calculating a plurality of at least one of virtual node-specific, and element-specific temperatures using the heat transfer coefficients, the virtual node-specific, and element-specific temperatures respectively specific to a time of the simulated quenching; and the computer useable medium is cooperative with the information input and the information output such that the received information is operated upon by the computer-readable program code means to be presented to the information output as a prediction of the transient heat transfer, or temperature distribution, or both of the aluminum casting.

DETAILED DESCRIPTION OF THE INVENTION

In water quenching processes, the heat transfer of hot metal objects to agitated water is generally considered to involve three main stages including film boiling, nucleate boiling, and convection. For cast aluminum components, however, it was discovered that the heat transfer in the transition boiling between film boiling and nucleate boiling dominates.

Figure 1:
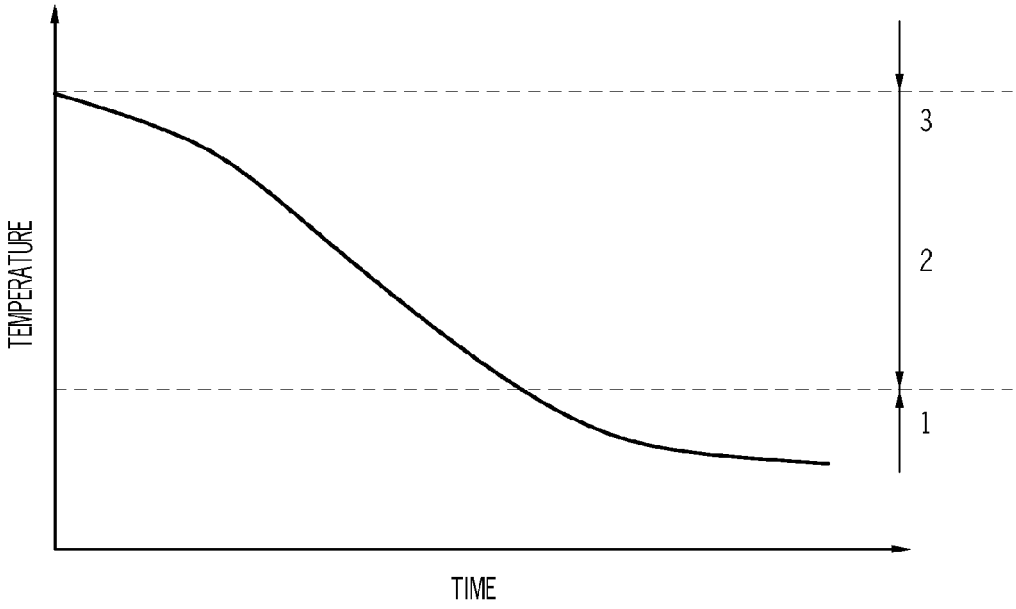
FIG. 1 (Prior Art)
FIG. 1 is a graph illustrating the three stages of cooling during water quenching.
Figure 2:
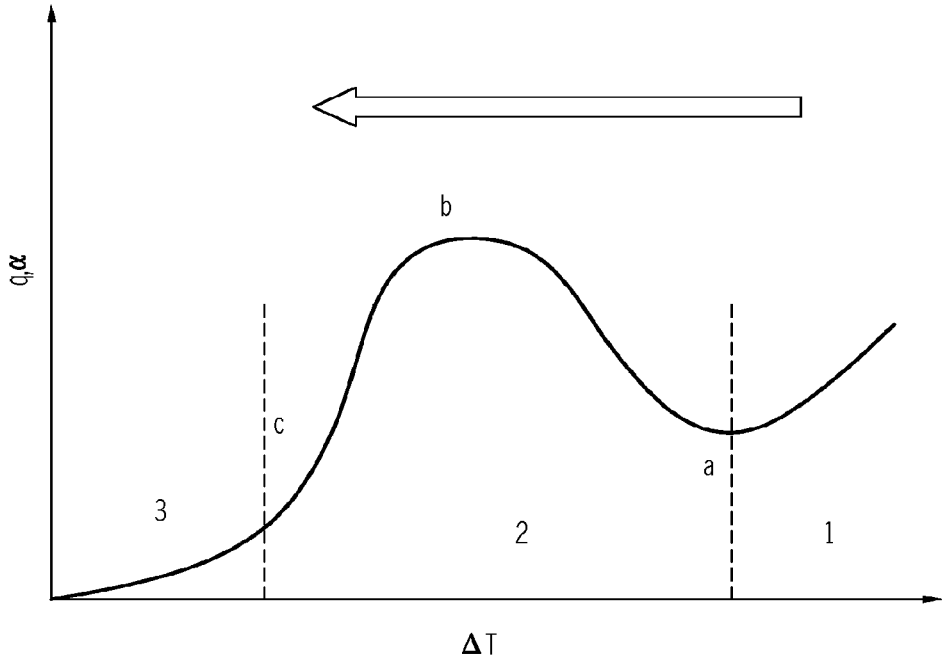
FIG. 2 (Prior Art)
FIG. 2 is a graph illustrating heat transfer and heat transfer rate versus temperature difference in water quenching.
Figure 3:
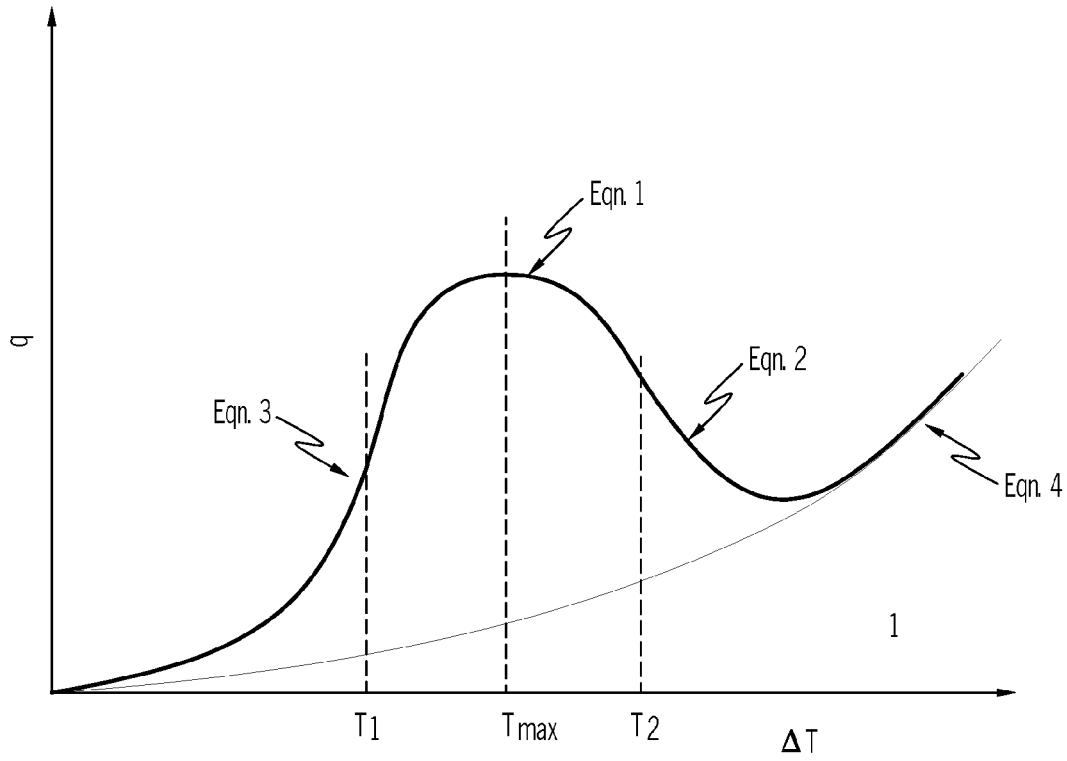
FIG. 3 is a graph illustrating heat transfer versus temperature difference in water quenching.
Figure 4A:
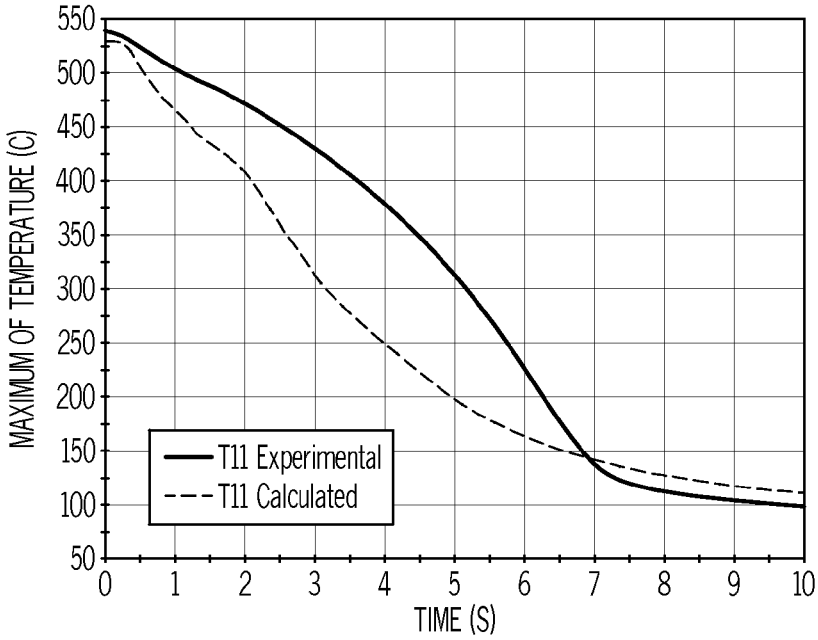
FIGS. 4A-B are graphs comparing calculated temperature distributions of a test aluminum casting quenched in water at thermocouples 11 and 12 using the state-of-the-art computational fluid dynamics code with experimental measurements.
Figure 4B:
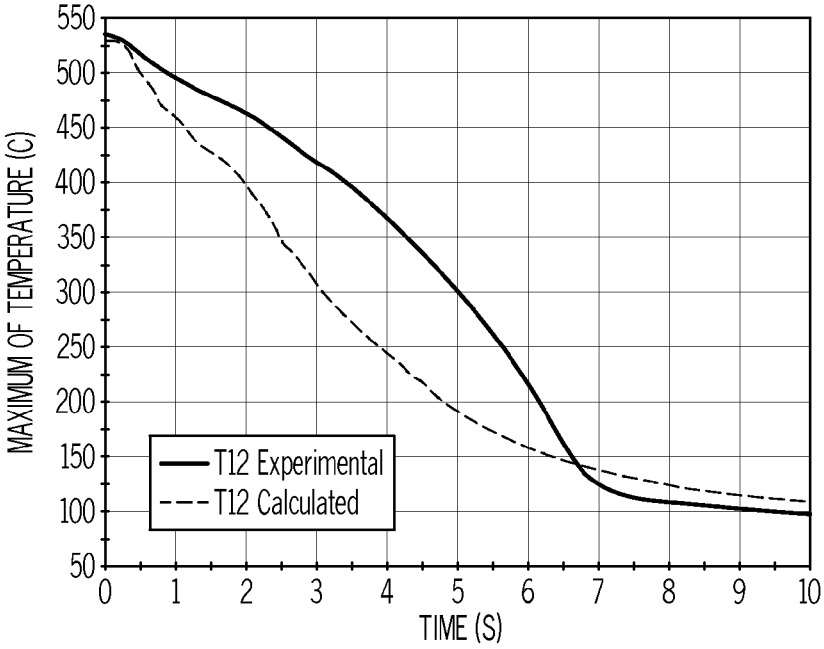
Figure 5A:
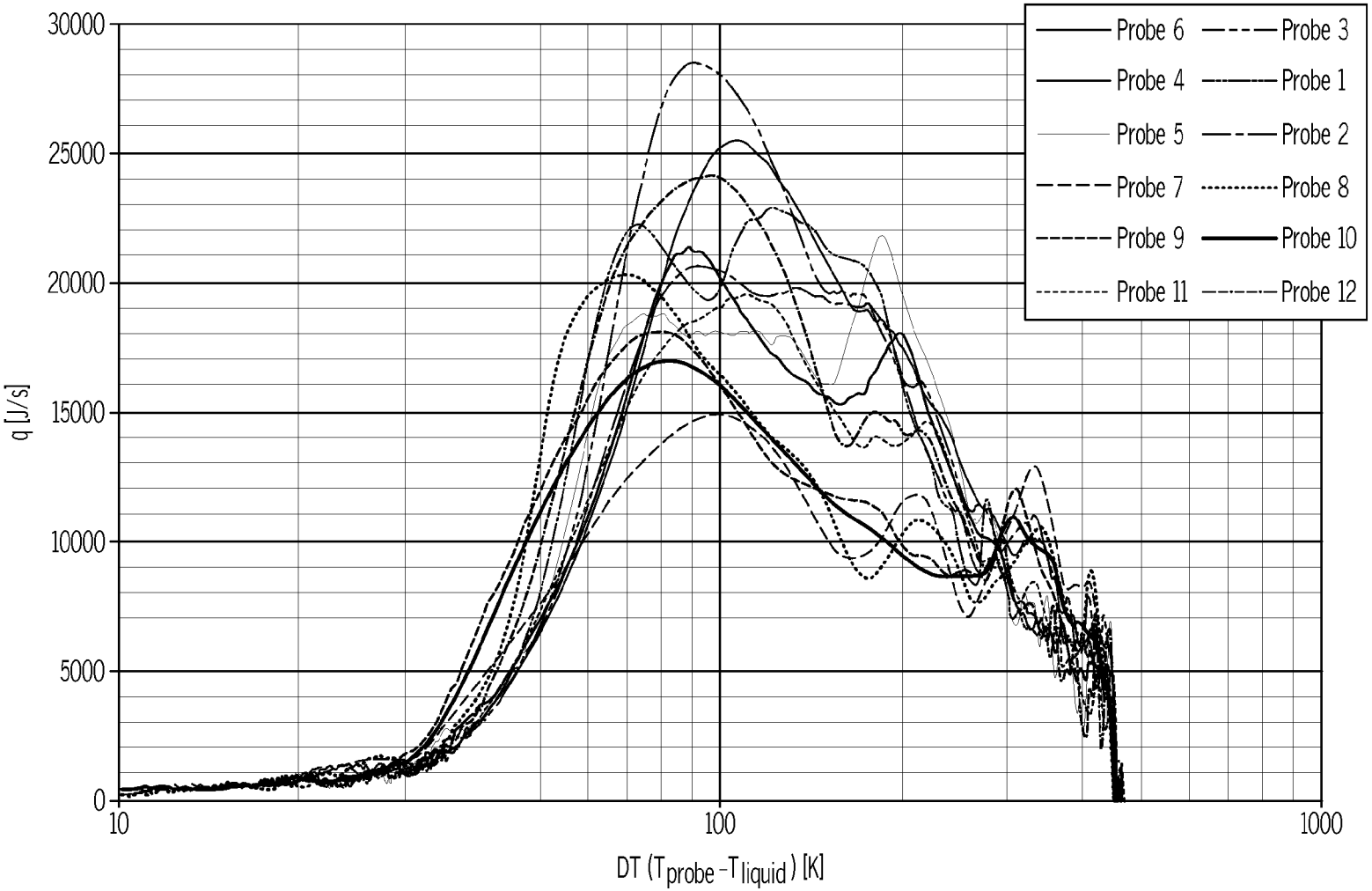
FIG. 5A is a graph comparing the measured heat transfer fluxes versus temperature differences in the water quenching of A356 casting solution-treated at 540 C and quenched in water at 74 C.
Figure 5B:
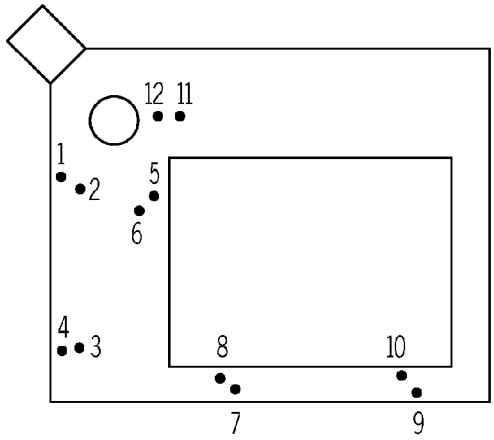
FIG. 5B is an illustration of the location for the thermocouples.

FIG. 5A shows the heat flux calculated from the cooling curves measured with 12 thermocouples instrumented in the picture-frame shape aluminum casting that was quenched vertically in warm water (74° C.). The position of the thermocouples is shown in FIG. 5B. Although notable differences can be observed in the heat transfer curves between the different thermocouples, the general trend is quite similar. For cast aluminum alloy (A356) solution-treated at 540° C., it was discovered that the heat transfer from nucleate boiling and in particular transition boiling is dominant. However, the film boiling is very limited. This is probably due to the low surface temperature of the casting when it is quenched into water. The variation in heat flux from location to location can be attributed to bubble formation, movement, and their interaction.

There is no analytical model or empirical equations reported in the literature or public domain to calculate the heat transfer during transition stage between film and nucleate boiling because the boiling process is so complicated.

In the transition regime, both nucleate boiling and film boiling are assumed to be present with the flow physics oscillating between the two regimes in an unstable manner. Thus, the transition functions attempt to blend both contributions through polynomials.

Figure 6:
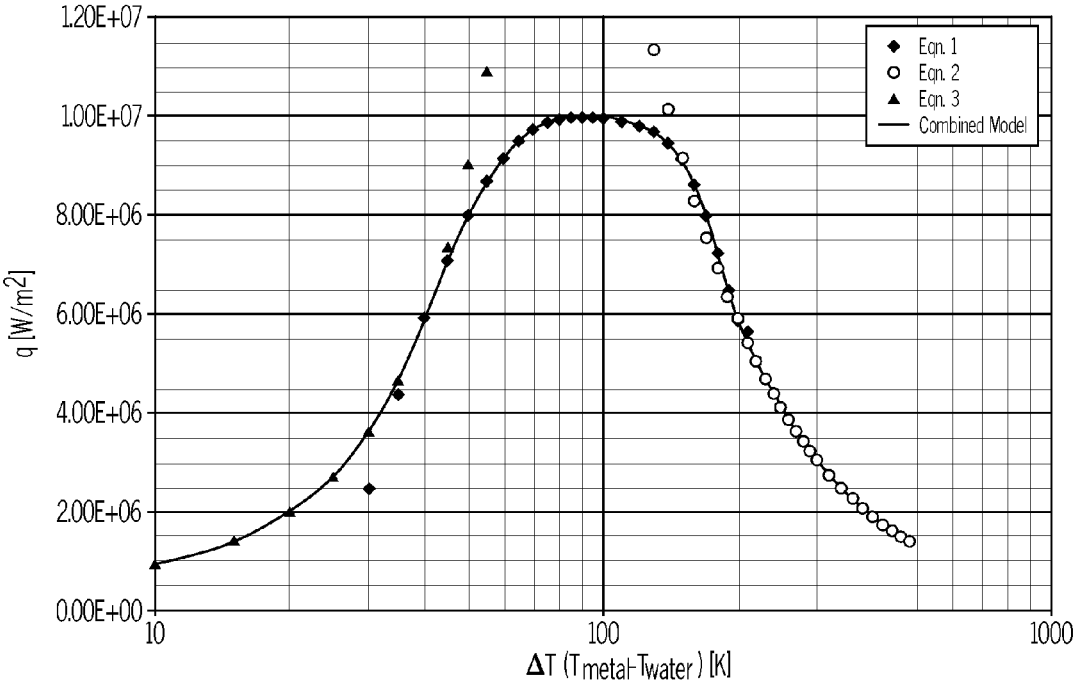
FIG. 6 is a graph showing heat flux versus temperature difference in water quenching.
Figure 7:
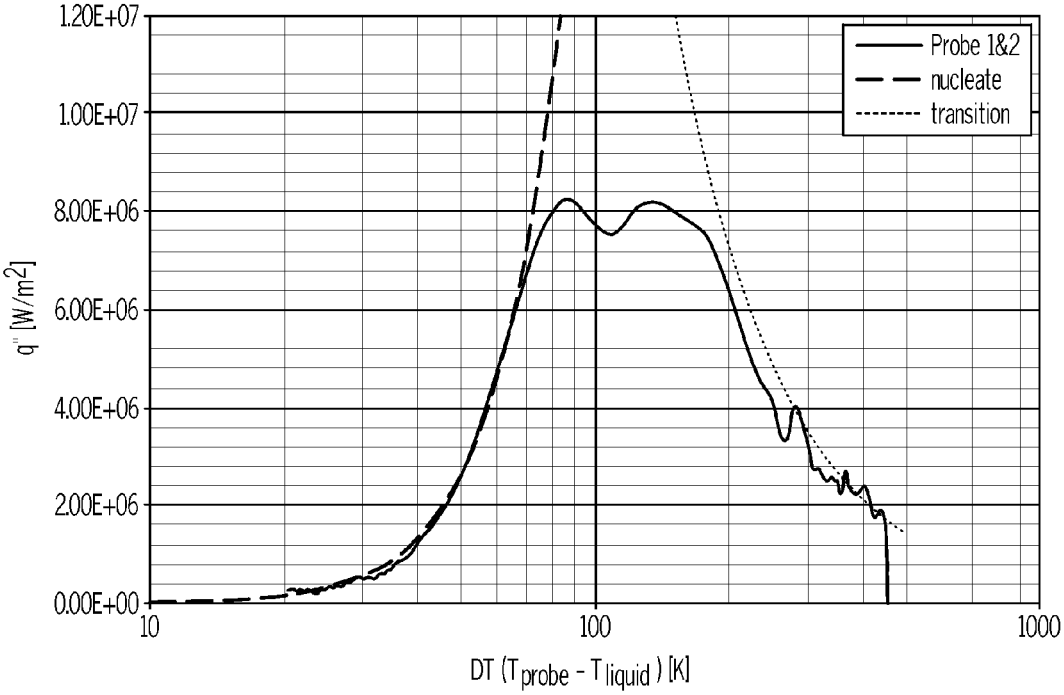
FIG. 7 is a graph comparing the calculated heat flux with the measured values for thermocouples 1 and 2 instrumented in the casting.
Figure 8:
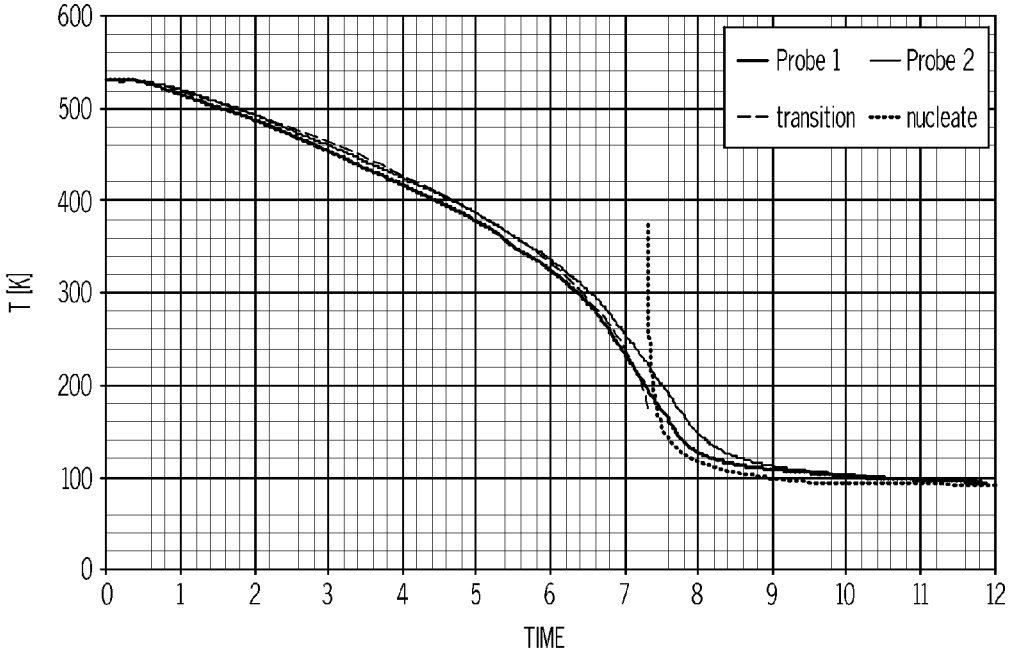
FIG. 8 is a graph comparing the calculated temperature distributions with the measured cooling curves for thermocouples 1 and 2.
Figure 9:
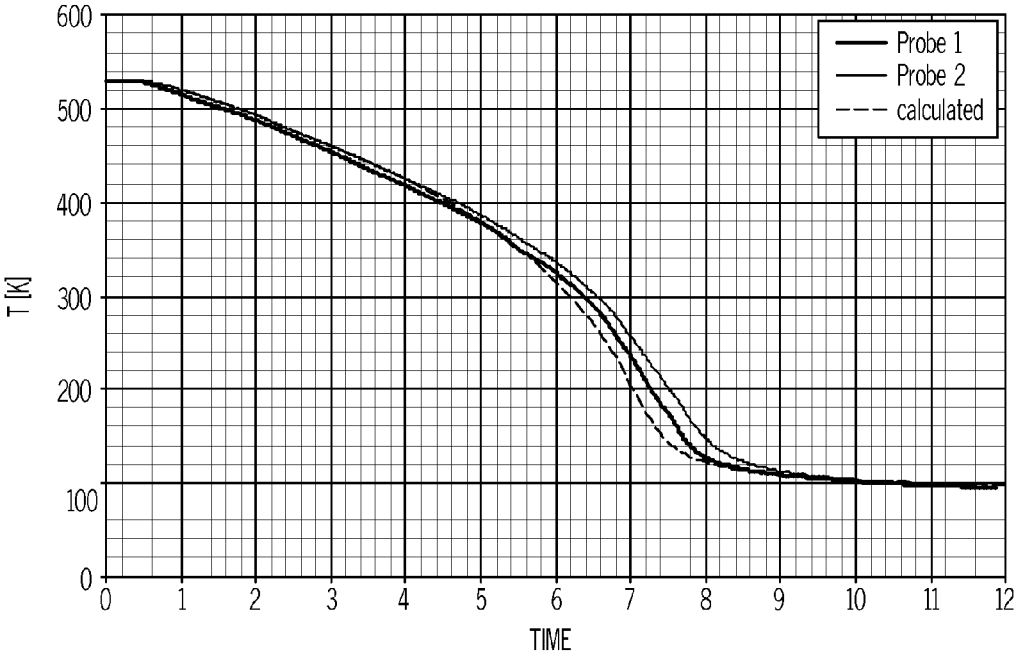
FIG. 9 is a graph comparing the calculated temperature distribution with the measured cooling curves for thermocouples 1 and 2.
Figure 10:
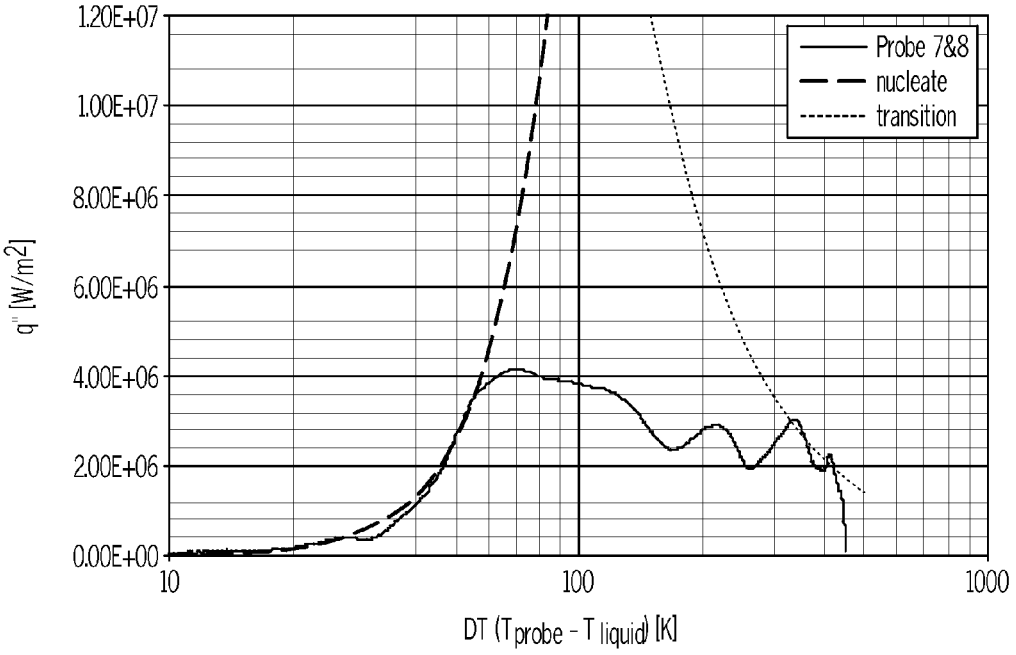
FIG. 10 is a graph comparing the calculated heat flux with the measured values for thermocouples 7 and 8.
Figure 11:
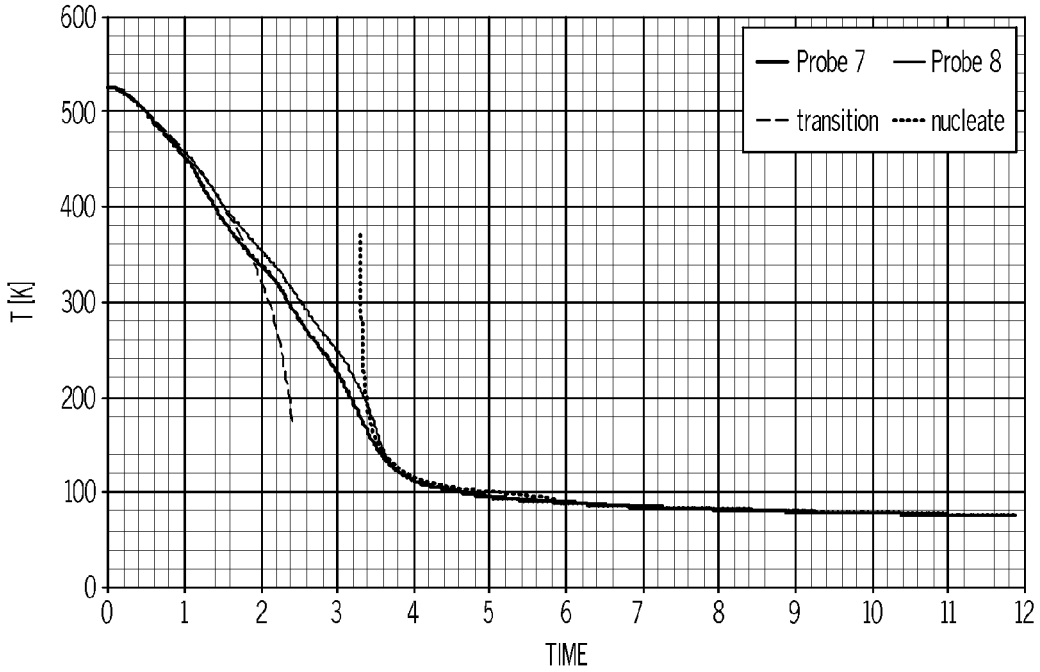
FIG. 11 is a graph comparing the calculated temperature distribution with the measured cooling curves for thermocouples 7 and 8.
Figure 12:
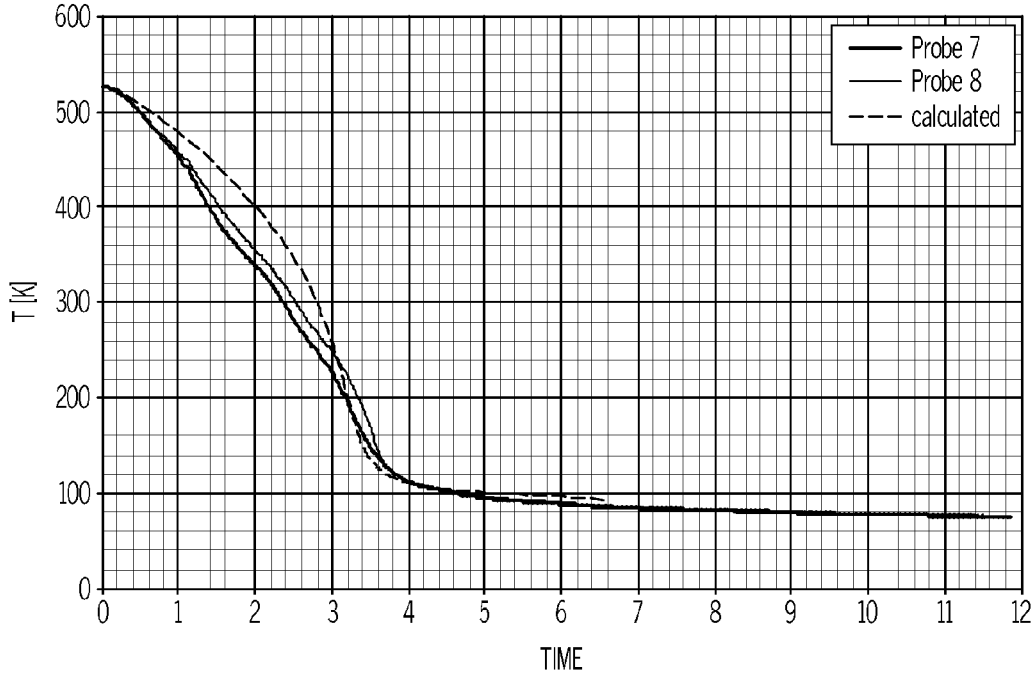
FIG. 12 is a graph comparing the calculated temperature distribution with the measured cooling curves for thermocouples 7 and 8.

It was found that the heat flux transferred from the hot cast aluminum components to agitated water during the transition stage can be described by two functions as illustrated in FIG. 6: one called the "critical point function" that defines the maximum heat flux point $q_{max}$ (Eqn. 3), and the other called the transition boiling function (Eqn. 4). In nucleate boiling, the heat flux follows Eqn. 5.

$$q = q_{max} - q_0\left(\frac{T_{metal} - T_{max}}{T_2 - T_1}\right)^2 \tag{3}$$

$$q = k_1 \Delta T^{k_2} \tag{4}$$

$$q = c_1 \Delta T^{c_2} \tag{5}$$

where:

$\Delta T$ is the temperature difference (° K) between the hot cast aluminum component and the water used to quench the component;

$T_{metal}$ is the surface temperature of the aluminum casting during quench;

$T_2$ is the temperature at the intersection point of the two curves described by the critical point function (Eqn. 3) and Eqn. 4;

$T_1$ is the temperature at the intersection point of the two curves described by the critical point function (Eqn. 3) and Eqn. 5;

$$T_{max} = \frac{T_1 + T_2}{2};$$

and $c_1$, $c_2$, $q_{max}$, $q_0$, $k_1$, and $k_2$ are constants that depend upon the quench conditions.

For cast aluminum alloys:

$c_1$ varies from about 2000 to about 13000 W/(m$^2$K$^{c2}$), or about 3500 to about 11,000 W/(m$^2$K$^{c2}$);

$c_2$ varies from about 1.3 to about 1.9, or about 1.4 to about 1.6;

$q_{max}$ varies from 1.5E+06 to 3E+06 W/m$^2$, or 1.5E+06 to 2.25E+06 W/m$^2$;

$k_1$ varies from 5E+09 to 9E+09 W/(m$^2$K$^{k2}$), or 6E+09 to 7E+09 W/(m$^2$K$^{k2}$); and $k_2$ varies from about −1.5 to about −2.0, or about −1.6 to about −1.7.

It should be noted that the critical point function is designed to bridge the nucleate boiling curve and transition boiling curve smoothly. Alternative functions for the critical point function may be used if desired, although the critical point function shown in Eqn. (3) appears to be the best choice. Given below are examples of several alternative critical point functions.

$$q^n = a_0 + a_1\Delta T + a_2\Delta T^2 + a_3\Delta T^3 + \ldots + a_n\Delta T^n \quad (T_1 \leq T_{metal} \leq T_2) \tag{6}$$

where $\Delta T$ is the temperature difference between hot cast aluminum component and warm water (° K); $a_0$, $a_1$, $a_2$, $a_3$, . . . , and $a_n$, are constants that depend upon the quench conditions.

$$q = q_{max} - \left(1 - 4\left((1-\varphi)\left(\frac{T_{metal} - T_{max}}{T_2 - T_1}\right)^2\right)\right)(T_1 \leq T_{metal} \leq T_2) \tag{7}$$

When $\phi$=0.75, Eqn. (7) can be simplified as:

$$q = q_{max} - \left(1 - \left(\frac{T_{metal} - T_{max}}{T_2 - T_1}\right)^2\right)(T_1 \leq T_{metal} \leq T_2) \tag{8}$$

$$q(T_1) = q(T_2) = \varphi q_{max} \tag{9}$$

If one of the alternate critical point function equations is used, then $T_1$ and $T_2$ would be the temperature at the intersection point of the critical point function (Eqns. 6-9) and Eqns. 4 and 5 respectively.

As described above, the transition boiling between film boiling and nucleate boiling can be represented with two "shape" functions, as shown in Eqns. 3-5 and 6-9. Using the optimized constants in the "shape" equations, the calculated temperature vs. time distributions during quenching are in a very good agreement with experimental measurements of the cooling curves, as shown in FIGS. 7-12.

These equations can be implemented in any existing commercially available computational fluid dynamics (CFD) code to provide a more accurate estimate of the heat transfer during water quenching. They could also be used in any finite element method, finite difference method, volume of fluid (VOF), or other method to provide solutions for all of the nodes in the casting. The implementation includes superposition of convective (single phase) and boiling heat flux at a solid-fluid interface.

In computational fluid dynamics (CFD) analysis of the hot aluminum casting quenched into the agitated water, the flow system of the aluminum casting and the quenchant water is broken down into an appropriate number of finite volumes or areas, referred to as cells, and expressions representing the continuity, momentum, and energy equations for each cell are solved. The process of breaking down the system domain into finite volumes or areas is known as mesh generation. The number of cells in a mesh varies depending on the level of accuracy required, the complexity of the system, and the models used. Equations solve for water flow (x, y, and z velocities), energy exchange (heat fluxes and temperatures), phase transformation (vapor bubbling), and pressure change based on various simplifications and/or assumptions.

The water flow velocities (in x, y, and z directions) during quenching may be modeled using the partial differential equations (PDE's) for the equation of motion (Eqn. 10) and the continuity equation (Eqn. 11).

$$\rho\frac{dv}{dt} = -\nabla p - [\nabla\cdot\tau] + \rho g + S_v^C \tag{10}$$

$$\frac{\partial\rho}{dt} + (\nabla\cdot\rho v) = S_m^C \tag{11}$$

where v is the velocity vector; ρ is the density; g is gravitational acceleration vector; and t is time.

These PDE's contain source terms ($S_v^C$ and $S_m^C$) that account for velocity and mass exchange between the aluminum casting and agitated water. The PDE for the equation of motion is typically expanded into two or three PDE's, with each PDE calculating a specific dimensional velocity field. Each equation of motion contains a viscous stress term (τ) that is solved based on the fluid properties (viscosity) and conditions (laminar/turbulent). Each equation of motion contains a pressure term which necessitates solving the pressure field. Pressure is typically coupled to the equations of motion and the continuity equation.

Transient boiling flow profiles may be solved using an Eulerian framework for both laminar (film boiling) and turbulent (nucleate boiling) flow. An Eulerian framework solves for variables (velocities) assuming a continuum of fluid. The liquid (water) phase is dominant and is described as continuous while the vapor bubbles are described as a dispersed phase. Due to the lower density of vapor, it may be assumed that, in nucleate boiling flow, the motion of the dispersed vapor phase follows the fluctuations in the continuous liquid phase. Accordingly, the turbulence stresses are modeled only for the liquid phase.

In one embodiment of this invention, the turbulence boiling flow may be modeled using a modified k-ϵ model with additional terms considering additional bubble-induced turbulence generated by fluctuating wakes behind the large bubbles as well as the influence of bubble interaction at different locations during water quenching.

$$\frac{\partial}{\partial t}(\alpha_l\rho_l k_l) + \nabla\cdot(\alpha_l\rho_l\bar{u}_l k_l) = \nabla\cdot\left(\alpha_l\frac{\mu_l^{turb}}{\sigma_k}\nabla k_l\right) + P_l - \rho_l\varepsilon_l + \gamma S_l^k \tag{12}$$

-continued $$\frac{\partial}{\partial t}(\alpha_l\rho_{l1}\varepsilon_l) + \nabla\cdot(\alpha_l\rho_l\bar{u}_l\varepsilon_l) = \nabla\cdot\left(\alpha_l\frac{\mu_l^{turb}}{\sigma_\varepsilon}\nabla\varepsilon_l\right) + \frac{\varepsilon_l}{k_l}(C_{l\varepsilon}P_l - C_{2\varepsilon}\rho_l\varepsilon_l) + \beta S_l^\varepsilon \tag{13}$$

where $P_l$ is the production of turbulence due to the liquid (water) shear stress, $k_l$ is liquid (water) turbulent kinetic energy; $\mu_l$ is total dynamic viscosity of liquid (water) which depends on the vapor phase volume fraction $(1-\alpha_l)$, $\rho_l$ is density of liquid (water), and γ and β are location dependent coefficients. Two additional source terms corresponding to the bubble induced turbulence are:

$$S_l^k = \bar{F}_D\cdot(\bar{u}_g - \bar{u}_l) \tag{14}$$

$$S_l^\varepsilon = C_{\varepsilon 3}\frac{S_l^k}{t_c} \tag{15}$$

where $\bar{F}_D$ is the interfacial drag force and $t_c$ is a characteristic time for bubble induced turbulence.

$$t_c = \left(\frac{d_b^2}{\varepsilon_l}\right)^C \tag{16}$$

where $d_b$ is the bubble diameter and $\epsilon_l$ is the rate of dissipation of liquid (water) turbulent kinetic energy.

Figure 13:
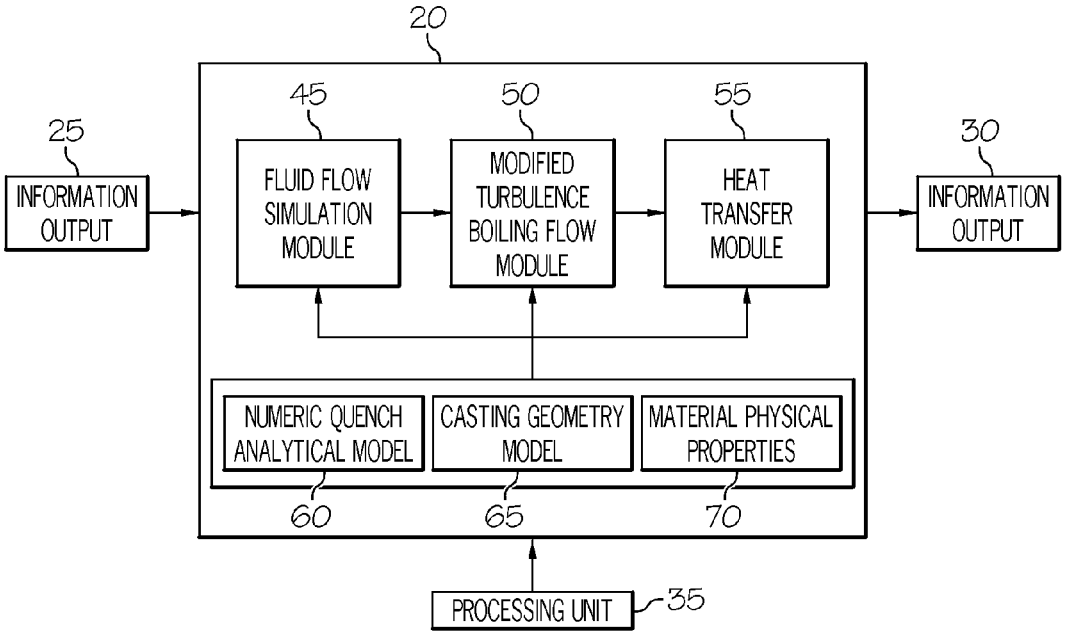
FIG. 13 illustrates a system to predict heat transfer and temperature distribution in an aluminum casting during quenching according to one embodiment of the present invention.

In one embodiment, shown in FIG. 13, a system 20, for example, may predict transient heat transfer and temperature distribution of an aluminum casting during quenching. The system 20 comprises an information input 25, an information output 30, a processing unit 35, and a computer-readable medium 40. The information input is configured to receive the information relating to the aluminum casting, while the information output is configured to convey information relating to the transient heat transfer and temperature distribution of the aluminum casting (during or after quenching) predicted by the system. The computer-readable medium 40 comprises a computer readable program code embodied therein, the computer readable program code comprising a fluid flow simulation module 45, a modified turbulence boiling flow module 50, and a heat transfer module 55. Further, the computer-readable medium may comprise a numerical quench analytical model 60, which includes a quench tank or quench container geometric model and quenching boundary conditions. It can also include a casting geometry model 65, which includes geometric information for the casting to be quenched. There can also be a material physical properties module 70, which includes information on the physical properties of the material, including, but not limited to, density, thermal conductivity, viscosity, and the like. The numerical quench analytic model 60, casting geometry model 65, and material physical properties module 70 provide information to the fluid flow simulation module 45, the turbulence boiling flow module 50, and the heat transfer module 55. The processing unit 35 is in communication with, and processes the calculations and other data of, the computer-readable medium 40 to predict the transient heat transfer and temperature distribution of an aluminum casting during quenching.

Further, it is noted that recitations herein of a component of an embodiment being "configured" in a particular way or to embody a particular property, or function in a particular manner, are structural recitations as opposed to recitations of intended use. More specifically, the references herein to the manner in which a component is "configured" denotes an existing physical condition of the component and, as such, is to be taken as a definite recitation of the structural factors of the component.

It is noted that terms like "generally," "commonly," and "typically," when utilized herein, are not utilized to limit the scope of the claimed embodiments or to imply that certain features are critical, essential, or even important to the structure or function of the claimed embodiments. Rather, these terms are merely intended to identify particular aspects of an embodiment or to emphasize alternative or additional features that may or may not be utilized in a particular embodiment.

For the purposes of describing and defining embodiments herein it is noted that the terms "substantially," "significantly, " and "approximately" are utilized herein to represent the inherent degree of uncertainty that may be attributed to any quantitative comparison, value, measurement, or other representation. The terms "substantially," "significantly," and "approximately" are also utilized herein to represent the degree by which a quantitative representation may vary from a stated reference without resulting in a change in the basic function of the subject matter at issue.

Having described embodiments of the present invention in detail, and by reference to specific embodiments thereof, it will be apparent that modifications and variations are possible without departing from the scope of the embodiments defined in the appended claims. More specifically, although some aspects of embodiments of the present invention are identified herein as preferred or particularly advantageous, it is contemplated that the embodiments of the present invention are not necessarily limited to these preferred aspects.

What is claimed is:

1. A method for estimating heat transfer during water quench of an aluminum part comprising:

estimating the heat transfer of the aluminum part when a temperature of the part is greater than 500° C. using $$q=\alpha(\Delta T) \quad (1);$$

estimating the heat transfer of the aluminum part when the temperature of the part is greater than $T_2$ and less than 500° C. using $$q=k_1\Delta T^{k_2} \quad (4);$$

estimating the heat transfer of the aluminum part when the temperature of the part is greater than $T_1$ and less than $T_2$ using a critical point function equation selected from:

$$q = q_{max} - q_0\left(\frac{T_{metal} - T_{max}}{T_2 - T_1}\right)^2, \quad (3)$$

$$q^n = a_0 + a_1\Delta T + a_2\Delta T^2 + a_3\Delta T^3 + \ldots + a_n\Delta T^n, \quad (6)$$

or $$q(T_1) = q(T_2) = \varphi q_{max}; \quad (9)$$

estimating the heat transfer of the aluminum part when the temperature of the part is less than $T_1$ using $$q=c_1\Delta T^{c_2} \quad (5);$$

where:

$\Delta T$ is the temperature difference (° K) between the hot cast aluminum component and the water used to quench the part;

$T_{metal}$ is the surface temperature of the part during quench;

$T_2$ is the temperature at an intersection point of the two curves described by equation (3) and equation (4);

$T_1$ is the temperature at the intersection point of the two curves described by equation (3) and equation (5);

$$T_{max} = \frac{T_1 + T_2}{2};$$

and $c_1$, $c_2$, $q_{max}$, $q_0$, $k_1$, $k_2$, and $a_0$, $a_1$, $a_2$, $a_3$, . . . , and $a_n$, are constants that depend upon quench conditions.

2. A system to predict transient heat transfer, or temperature distribution, or both of a quenched aluminum casting, the system comprising:

an information input configured to receive information relating to at least one of a plurality of at least one of nodes, and elements of the aluminum casting during a quenching thereof;

an information output configured to convey information relating to transient heat transfer, or temperature distribution, or both of the aluminum casting predicted by the system;

a computer processor; and a computer-readable medium comprising a computer-readable program code embodied therein, said computer-readable medium cooperative with the computer processor, the information input and the information output such that the received information is operated upon by the computer processor and computer-readable program code to be presented to the information output as transient heat transfer, or temperature distribution, or both of the aluminum casting, said computer-readable program code comprising a fluid flow simulation module, a turbulence boiling flow module, and a heat transfer module, wherein:

the fluid flow simulation module simulates a quenching process of a virtual aluminum casting replicative of the aluminum casting and the quenching thereof, the virtual aluminum casting comprising a plurality of at least one of virtual surface nodes, and elements correlated with the surface geometries of the aluminum casting, the virtual aluminum casting respectively comprising a plurality of at least one of dimensional nodes, and elements;

the turbulence boiling flow module simulates one or more of a velocity profile for a liquid phase, a pressure profile, and vapor/water phase interactions;

the heat transfer module calculates a plurality of heat transfer coefficients specific to the respective virtual surface nodes, and elements;

the heat transfer module estimates the heat transfer of the aluminum part when a temperature of the part is greater than 500° C. using $$q=\alpha(\Delta T) \quad (1);$$

estimates the heat transfer of the aluminum part when the temperature of the part is greater than $T_2$ and less than 500° C. using $$q=k_1\Delta T^{k_2} \quad (4);$$

estimates the heat transfer of the aluminum part when the temperature of the part is greater than $T_1$ and less than $T_2$ using a critical point function equation selected from:

$$q = q_{max} - q_0\left(\frac{T_{metal} - T_{max}}{T_2 - T_1}\right)^2, \quad (3)$$

$$q^n = a_0 + a_1\Delta T + a_2\Delta T^2 + a_3\Delta T^3 + \ldots + a_n\Delta T^n, \quad (6)$$

or $$q(T_1) = q(T_2) = \varphi q_{max}; \quad (9)$$

and estimates the heat transfer of the aluminum part when the temperature of the part is less than $T_1$ using $$q = c_1\Delta T^{c_2} \quad (5);$$

where:

$\Delta T$ is the temperature difference (° K) between the hot cast aluminum component and the water used to quench the part;

$T_{metal}$ is the surface temperature of the part during quench;

$T_2$ is the temperature at an intersection point of the two curves described by equation (3) and equation (4);

$T_1$ is the temperature at the intersection point of the two curves described by equation (3) and equation (5);

$$T_{max} = \frac{T_1 + T_2}{2};$$

and $c_1, c_2, q_{max}, q_0, k_1, k_2$, and $a_0, a_1, a_2, a_3, \ldots$, and $a_n$, are constants that depend upon quench conditions; and the heat transfer module calculates a plurality of at least one of virtual node-specific, and element-specific temperatures using the heat transfer coefficients, the virtual node-specific, and element-specific-temperatures respectively specific to a time of the simulated quenching.

3. The system of claim 2, wherein the received information comprises information relating to at least one of a plurality of material properties of the aluminum casting.

4. The system of claim 3 wherein the material properties comprise density, thermal conductivity, and viscosity.

5. The system of claim 2, wherein the turbulence boiling flow module calculates the turbulence boiling flow using $$\frac{\partial}{\partial t}(\alpha_1\rho_1 k_1) + \nabla\cdot(\alpha_1\rho_1\bar{u}_1 k_1) = \nabla\cdot\left(\alpha_1\frac{\mu_1^{turb}}{\sigma_k}\nabla k_1\right) + P_1 - \rho_1\varepsilon_1 + \gamma S_l^k \quad (12)$$

$$\frac{\partial}{\partial t}(\alpha_1\rho_1\varepsilon_1) + \nabla\cdot(\alpha_1\rho_1\bar{u}_1\varepsilon_1) = \nabla\cdot\left(\alpha_1\frac{\mu_1^{turb}}{\sigma_\varepsilon}\nabla\varepsilon_1\right) + \frac{\varepsilon_1}{k_1}(C_{1\varepsilon}P_1 - C_{2\varepsilon}\rho_1\varepsilon_1) + \beta S_l^\varepsilon \quad (13)$$

where $P_l$ is the production of turbulence due to the liquid (water) shear stress, $k_l$ is liquid (water) turbulent kinetic energy; $\mu_l$ is total dynamic viscosity of liquid (water) which depends on the vapor phase volume fraction $(1-\alpha_l)$, $\rho_l$ is density of liquid (water), $$S_l^k = -\bar{F}_D\cdot(\bar{u}_g - \bar{u}_l) \quad (14)$$

$$S_l^\varepsilon = C_{\varepsilon 3}\frac{S_l^k}{t_c} \quad (15)$$

where $\bar{F}_D$ is the interfacial drag force and $t_c$ is a characteristic time for bubble induced turbulence, $$t_c = \left(\frac{d_b^2}{\varepsilon_l}\right)^C \quad (16)$$

where $d_b$ is the bubble diameter and $\epsilon_l$ is the rate of dissipation of liquid (water) turbulent kinetic energy.

6. The system of claim 2 wherein the virtual surface elements and nodes of the virtual aluminum casting comprises at least one top surface of the virtual aluminum casting, at least one side surface, and at least one bottom surface of the virtual aluminum casting relative to a quench orientation.

7. The system of claim 6 wherein the virtual surfaces respectively comprise a plurality of dimensional elements respectively defined by a length (x), a width (y), and a depth (z).

8. A method of predicting transient heat transfer, or temperature distribution, or both of an aluminum casting, the method comprising:

providing the aluminum casting, the aluminum casting comprising at least one of a plurality of at least one of nodes, and elements and has been quenched via a quenching process;

simulating a quenching process of a virtual aluminum casting replicative of the aluminum casting and the quenching thereof, wherein the virtual aluminum casting comprises at least one of a plurality of virtual surface zones correlated with the nodes, and elements of the aluminum casting and the virtual surface zones respectively comprise a plurality of dimensional elements and the dimensional elements respectively comprise a plurality of nodes;

calculating the turbulence boiling flow of the respective virtual nodes, and elements;

estimating the heat transfer of the aluminum part when a temperature of the part is greater than 500° C. using $$q = \alpha(\Delta T) \quad (1);$$

estimating the heat transfer of the aluminum part when the temperature of the part is greater than $T_2$ and less than 500° C. using $$q = k_1\Delta T^{k_2} \quad (4);$$

estimating the heat transfer of the aluminum part when the temperature of the part is greater than $T_1$ and less than $T_2$ using a critical point function equation selected from:

$$q = q_{max} - q_0\left(\frac{T_{metal} - T_{max}}{T_2 - T_1}\right)^2, \quad (3)$$

$$q^n = a_0 + a_1\Delta T + a_2\Delta T^2 + a_3\Delta T^3 + \ldots + a_n\Delta T^n, \quad (6)$$

or $$q(T_1) = q(T_2) = \varphi q_{max}; \quad (9)$$

estimating the heat transfer of the aluminum part when the temperature of the part is less than $T_1$ using $$q=c_1\Delta T^{c2} \tag{5}$$

where:

$\Delta T$ is the temperature difference (° K) between the hot cast aluminum component and the water used to quench the part;

$T_{metal}$ is the surface temperature of the part during quench;

$T_2$ is the temperature at an intersection point of the two curves described by equation (3) and equation (4);

$T_1$ is the temperature at the intersection point of the two curves described by equation (3) and equation (5);

$$T_{max} = \frac{T_1 - T_2}{2};$$

and $c_1$, $c_2$, $q_{max}$, $q_0$, $k_1$, $k_2$, and $a_0$, $a_1$, $a_2$, $a_3$, . . . , and $a_n$, are constants that depend upon quench conditions;

calculating a plurality of heat transfer coefficients specific to the respective virtual surface nodes, and elements;

calculating a plurality of at least one of virtual node-specific, and element-specific temperatures using the respective surface node-specific, and element-specific heat transfer coefficients, the virtual node-specific, and element-specific temperatures respectively specific to a time of the simulated quenching;

predicting heat transfer, or temperature distribution, or both of the respective virtual nodes, and elements using the virtual node-specific, and element-specific temperatures and a coefficient of thermal expansion/contraction.

9. The method of claim 8 wherein the turbulence boiling flow is calculated using $$\frac{\partial}{\partial t}(\alpha_1\rho_1 k_1) + \nabla\cdot(\alpha_1\rho_1\bar{u}_1 k_1) = \nabla\cdot\left(\alpha_1\frac{\mu_1^{turb}}{\sigma_k}\nabla k_1\right) + P_1 - \rho_1\varepsilon_1 + \gamma S_l^k \tag{12}$$

$$\frac{\partial}{\partial t}(\alpha_1\rho_1\varepsilon_1) + \nabla\cdot(\alpha_1\rho_1\bar{u}_1\varepsilon_1) = \nabla\cdot\left(\alpha_1\frac{\mu_1^{turb}}{\sigma_\varepsilon}\nabla\varepsilon_1\right) + \frac{\varepsilon_1}{k_1}(C_{1\varepsilon}P_1 - C_{2\varepsilon}\rho_1\varepsilon_1) + \beta S_l^\varepsilon \tag{13}$$

where $P_l$ is the production of turbulence due to the liquid (water) shear stress, $k_l$ is liquid (water) turbulent kinetic energy; $\mu_l$ is total dynamic viscosity of liquid (water) which depends on the vapor phase volume fraction ($1'\alpha_l$), $\rho_l$ is density of liquid (water), $$S_1^k = -\bar{F}_D\cdot(\bar{u}_g - \bar{u}_1) \tag{14}$$

$$S_l^\varepsilon = C_{\varepsilon 3}\frac{S_l^k}{t_c} \tag{15}$$

where $\bar{F}_D$ is the interfacial drag force and $t_c$ is a characteristic time for bubble induced turbulence, $$t_c = \left(\frac{d_b^2}{\varepsilon_l}\right)^C \tag{16}$$

where $d_b$ is the bubble diameter and $\epsilon_l$ is the rate of dissipation of liquid (water) turbulent kinetic energy.

10. An article of manufacture to predict transient heat transfer, or temperature distribution, or both of an aluminum casting, the article of manufacture comprising an information input, an information output, a computer processor, and at least one computer usable medium, wherein:

the information input is configured to receive information relating to at least one of a plurality of at least one of nodes, and elements of the aluminum casting during a quenching thereof;

the information output is configured to convey information relating to the transient heat transfer, or temperature distribution, or both of the aluminum casting predicted by the article of manufacture; and the computer processor cooperative with the computer useable medium to operate upon computer-readable program code means embodied on the computer useable medium for simulating a quenching of a virtual aluminum casting replicative of the aluminum casting and the quenching thereof, the virtual aluminum casting comprising at least one of a plurality of virtual surface nodes, and elements correlated with at least one of the nodes, and elements of the aluminum casting and the virtual surface zones respectively comprising a plurality of dimensional elements and virtual dimensional elements respectively comprising a plurality of nodes;

the computer useable medium comprises computer-readable program code means embodied thereon for calculating turbulence boiling flow;

the computer useable medium comprises computer-readable program code means embodied therein for:

estimating the heat transfer of the aluminum part when a temperature of the part is greater than 500° C. using $$q=\alpha(\Delta T) \tag{1}$$

estimating the heat transfer of the aluminum part when the temperature of the part is greater than $T_2$ and less than 500° C. using $$q=k_1\Delta T^{k2} \tag{4}$$

estimating the heat transfer of the aluminum part when the temperature of the part is greater than $T_1$ and less than $T_2$ using a critical point function equation selected from:

$$q = q_{max} - q_0\left(\frac{T_{metal} - T_{max}}{T_2 - T_1}\right)^2, \tag{3}$$

$$q^n = a_0 + a_1\Delta T + a_2\Delta T^2 + a_3\Delta T^3 + \ldots + a_n\Delta T^n, \tag{6}$$

or $$q(T_1) = q(T_2) = \varphi q_{max} \tag{9}$$

estimating the heat transfer of the aluminum part when the temperature of the part is less than $T_1$ using $$q=c_1\Delta T^{c2} \tag{5}$$

where:

$\Delta T$ is the temperature difference (° K) between the hot cast aluminum component and the water used to quench the part;

$T_{metal}$ is the surface temperature of the part during quench;

$T_2$ is the temperature at an intersection point of the two curves described by equation (3) and equation (4);

$T_1$ is the temperature at the intersection point of the two curves described by equation (3) and equation (5);

$$T_{max} = \frac{T_1 - T_2}{2};$$

and $c_1$, $c_2$, $q_{max}$, $q_0$, $k_1$, $k_2$, and $a_0$, $a_1$, $a_2$, $a_3$, . . . , and $a_n$, are constants that depend upon quench conditions;

the computer useable medium comprises computer-readable program code means embodied therein for calculating a plurality of heat transfer coefficients specific to the respective virtual surface nodes, and elements;

the computer useable medium comprises computer-readable program code means embodied therein for calculating a plurality of at least one of virtual node-specific, and element-specific temperatures using the heat transfer coefficients, the virtual node-specific, and element-specific temperatures respectively specific to a time of the simulated quenching; and the computer useable medium is cooperative with the information input and the information output such that the received information is operated upon by the computer-readable program code means to be presented to the information output as a prediction of the transient heat transfer, or temperature distribution, or both of the aluminum casting.

11. The article of claim 10 wherein the turbulence boiling flow is calculated using $$\frac{\partial}{\partial t}(\alpha_1\rho_1 k_1) + \nabla\cdot(\alpha_1\rho_1\bar{u}_1 k_1) = \nabla\cdot\left(\alpha_1\frac{\mu_1^{turb}}{\sigma_k}\nabla k_1\right) + P_1 - \rho_1\varepsilon_1 + \gamma S_1^k \tag{12}$$

$$\frac{\partial}{\partial t}(\alpha_1\rho_1\varepsilon_1) + \nabla\cdot(\alpha_1\rho_1\bar{u}_1\varepsilon_1) = \nabla\cdot\left(\alpha_1\frac{\mu_1^{turb}}{\sigma_\varepsilon}\nabla\varepsilon_1\right) + \frac{\varepsilon_1}{k_1}(C_{1\varepsilon}P_1 - C_{2\varepsilon}\rho_1\varepsilon_1) + \beta S_l^\varepsilon \tag{13}$$

where $P_l$ is the production of turbulence due to the liquid (water) shear stress, $k_l$ is liquid (water) turbulent kinetic energy; $\mu_l$ is total dynamic viscosity of liquid (water) which depends on the vapor phase volume fraction $(1-\alpha_l)$, $\rho_l$ is density of liquid (water), $$S_l^k = -\bar{F}_D\cdot(\bar{u}_g - \bar{u}_l) \tag{14}$$

$$S_l^\varepsilon = C_{\varepsilon 3}\frac{S_l^k}{t_c} \tag{15}$$

where $\bar{F}_D$ is the interfacial drag force and $t_c$ is a characteristic time for bubble induced turbulence, $$t_c = \left(\frac{d_b^2}{\varepsilon_l}\right)^C \tag{16}$$

where $d_b$ is the bubble diameter and $\epsilon_l$ is the rate of dissipation of liquid (water) turbulent kinetic energy.

* * * * *